United States Patent [19]

Eisenhawer et al.

[11] Patent Number: 4,498,542

[45] Date of Patent: Feb. 12, 1985

[54] DIRECT CONTACT LOW EMISSION STEAM GENERATING SYSTEM AND METHOD UTILIZING A COMPACT, MULTI-FUEL BURNER

[75] Inventors: Stephen Eisenhawer, Albuquerque; Anthony J. Mulac, Tijares; A. Burl Donaldson; Ronald L. Fox, both of Albuquerque, all of N. Mex.

[73] Assignee: Enhanced Energy Systems, Albuquerque, N. Mex.

[21] Appl. No.: 489,829

[22] Filed: Apr. 29, 1983

[51] Int. Cl.[3] ..... E21B 43/24; E21B 43/34

[52] U.S. Cl. ..... 166/303; 166/57

[58] Field of Search ..... 166/59, 303, 302, 261, 166/267, 57

[56] References Cited

U.S. PATENT DOCUMENTS 4,330,038 5/1982 Soukup et al. ..... 166/57 X
4,377,205 3/1983 Retallick ..... 166/59
4,385,661 5/1983 Fox ..... 166/59
4,398,603 8/1983 Rodwell ..... 166/57 X
4,411,618 10/1983 Donaldson et al. ..... 166/59 X

*Primary Examiner*—Stephen J. Novosad
*Attorney, Agent, or Firm*—Francis J. Lidd

[57] ABSTRACT

A high output, high pressure direct contact steam generator for producing high quality steam particularly suited for use with low grade, low cost fuel. When used in a system incorporating heat recovery and conversion of carryover water enthalpy into shaft horesepower, the unit disclosed provides high quality, high pressure steam for "steam drive" or thermal stimulation of petroleum wells through injection of high pressure steam and combustion gas mixtures. A particular feature of the burner/system disclosed provides compression of a burner oxidant such as atmospheric air, and shaft horesepower for pumping high pressure feedwater, from a lowest cost energy source such as leased crude, or other locally available fuel.

7 Claims, 4 Drawing Figures

FIG. 1
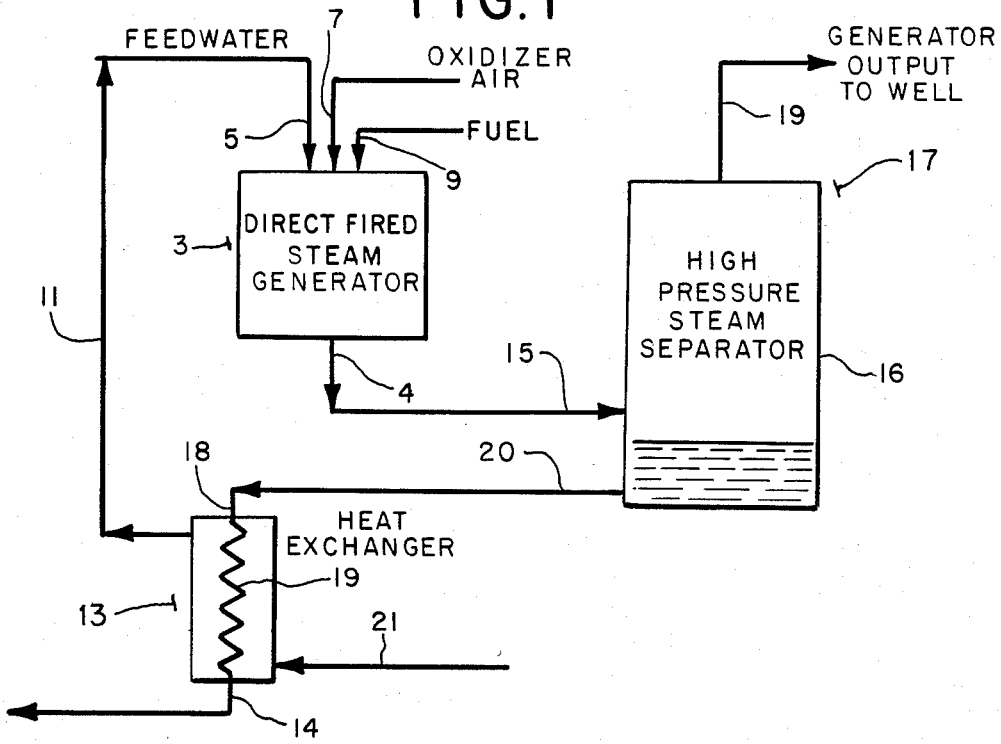
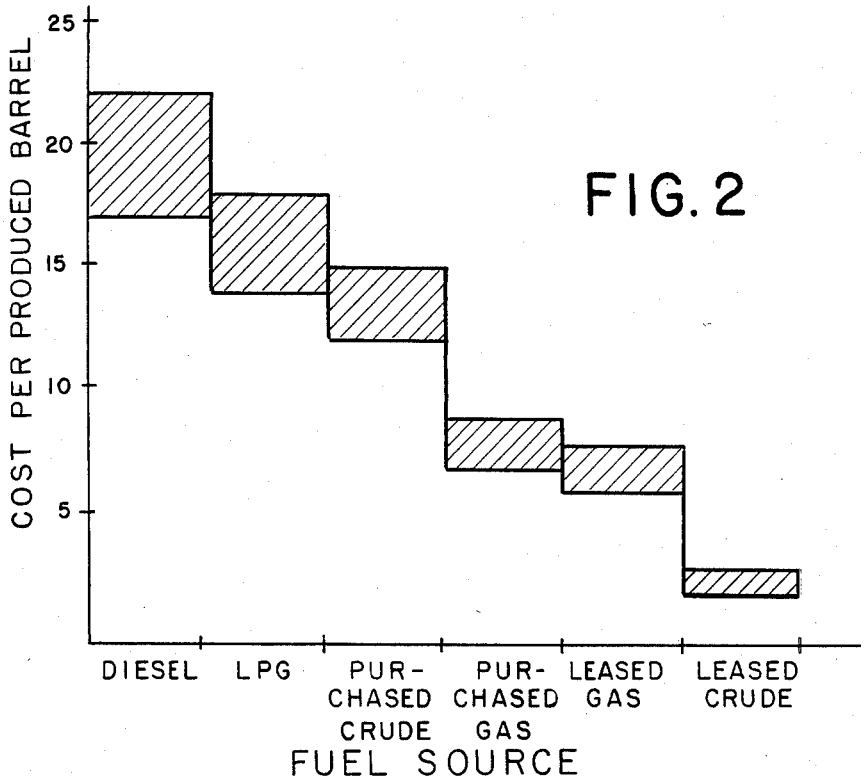
FIG. 2

DIRECT CONTACT LOW EMISSION STEAM GENERATING SYSTEM AND METHOD UTILIZING A COMPACT, MULTI-FUEL BURNER

REFERENCE TO RELATED APPLICATIONS

My co-pending application Ser. No. 489,855, filed on Apr. 29, 1983, titled: "Steam Generator Having a High Pressure Combustor, With Controlled Thermal and Mechanical Stresses and Utilizing Pyrophoric Ignition", discloses and claims a new and useful direct fired downhole steam generator having combustion control and extended life. That application and any amendments thereto are fully incorporated into this application by reference.

BACKGROUND OF THE INVENTION

The direct fired downhole steam generator disclosed and claimed in my above-mentioned co-pending application has found substantial use and has provided satisfactory and efficient thermal stimulation of existing oil wells, particularly where the sands subjected to "steam drive" are located at depths greater than 2,000 feet from the surface. However, there are a large number of wells wherein surface generated steam can be efficiently utilized.

As indicated in the above-mentioned co-pending application however, state of the art conventional steam generators or boilers operating on the earth's surface or abovehole, inherently produce substantial amounts of combustion or "stack gases" due to the nature of the combustion process employed. With these boilers, products of combustion cannot be prevented from entering the atmosphere. The obvious environmental impact of any such large scale combustion is highly undesirable and, in fact, has limited the use of surface steam generation by boilers in many areas where atmospheric pollution is critical.

Known direct contact steam generators operating at near atmospheric pressure require extremely large combustion chambers, in order to provide adequate heat exchange to the particular liquid being heated. Additionally, these units suffer and/or include shortcomings of both direct and indirect steam generation, in that due to the large areas of feedwater exposed to the combustion chamber, substantial amounts of combustion products are absorbed or dissolved into the heated water. However, since most of the combustion gas volume is not absorbed, substantial stack or exhaust gases must be vented to the atmosphere resulting in the aforementioned environmental problems.

Direct injections of both steam and combustion gases to enhance oil recovery has been shown to be more effective in thermal stimulation of the wells, since there is evidence to the effect that combustion gases are soluble and retained in crude oil, causing an increase in volume, thereby enhancing release from associated oil sand. High pressure combustion utilized in the direct steam generator of the system disclosed herein, provides increased thermal capacity for a given size, resulting in an equipment package greatly reduced in size.

Small generator size provides an additional advantage in the area of safety, since actual volume of generated steam within the generator at any given time is exceedingly small, greatly reducing the possibility of damage in the case of a generator failure.

Both downhole steam drive and surface generated steam drive however, suffer from the common economic problem of high fuel consumption due to the relatively large amount of heat required to thermally stimulate oil sands. A generally accepted figure within the industry is that approximately 30% (thirty percent) of the thermal energy recovered in stimulated production is returned or lost in the stimulation process. Fuel costs involved in thermal stimulation makes it exceptionally attractive for operators of steam drive equipment to utilize the locally available fuels such as leased crude, "heavy" oil, i.e. Bunker C or equivalent, or other carbonaceous material such as coal, sawdust, or other organic waste material.

As discussed above, conventional surface steam generators, particularly when fired with low cost fuels, emit substantial and objectionable combustion gases. This problem limits the use of fuels such as residual oil, leased crude oil, and other carbonaceous fuels in state of the art equipment. Further, both downhole and abovehole generating equipment, require that the combustion process must be essentially "clean", since injected steam and combustion products cannot be allowed to contaminate the oil sands they are required to stimulate.

Applicant's invention overcomes these difficulties through the use of high pressure combustion techniques, wherein the combustion process heats feedwater and generates steam after the combustion process is complete. A primary feature of the approach disclosed herein is a means for employing a high pressure combustor in order to utilize less desirable fuels known to generate undesirable atmospheric pollutants.

In keeping with the invention, undesirable material attendant to the combustion process are effectively removed from the generator output, providing a steam/combustion gas mixture which can be directly injected downhole for effective thermal stimulation.

BRIEF DESCRIPTION OF THE INVENTION

The invention disclosed herein, overcomes the problems of high fuel costs and "clean" combustion in that through use of high pressure surface combustion, both steam and combustion gases are injected downhole from the surface, thereby avoiding any emission of stack or combustion gas. The burner and system disclosed in this invention further provide for utilization of so-called "dirty" fuels, such as leased crude, or heavy oil, due to the absence of atmospheric emissions, since many contaminating products of combustion are removed prior to direct injection. Use of low cost fuel therefore provides a substantial economic advantage.

A further economic advantage is provided by the invention in that carryover water from the steam generation process, having substantial enthalpy or residual heat, is utilized to drive an oxidant compressor and further to heat incoming feedwater for the ongoing combustion process.

Those familiar with the combustion art will readily understand that the techniques of high pressure combustion employed in the burner utilized in this application, can successfully generate steam at efficiencies around 90% (ninety percent), while utilizing the vastly lower cost and heretofore undesirable and/or unusable fuels. Alternately, high quality, high cost fuels operate at efficiencies of 98% (ninety eight percent). Therefore, applicant has discovered that for a relatively small reduction in overall combustor efficiency when using low cost fuel, approximately a 300% (three hundred percent) reduction in fuel costs of thermal stimulation can be achieved. Possible reductions in fuel cost can easily be seen by reference to FIG. 2.

As disclosed herein, the apparatus and methods taught will provide an advance in the art of high pressure, direct-fired steam generation, while accomplishing the following objectives;

An object of this invention is to provide a direct-fired, high pressure steam generator which delivers high quality steam, through combustion inter alia, of low cost, heretofore undesirable fuels.

An additional object of this invention is to provide a direct-fired, high pressure steam generator wherein the environmental emissions are minimized through the use of high pressure combustion techniques.

It is an additional object of this invention to provide a system utilizing a direct-fired, high pressure steam generator wherein the prime movers for compressing the fuel oxidant and delivering feedwater are operated from a lowest cost, commonly used and available fuel through heat recovery techniques.

It is an additional object of this invention to provide a method for generating high pressure, high quality steam and combustion gases for thermal stimulation of petroleum wells wherein there is no atmospheric emission, and undesirable combustion products are recovered for disposal and/or treatment.

BRIEF DESCRIPTION OF THE DRAWINGS

FIG. 1 is a partial schematic drawing of the primary embodiment of the invention, showing the basic concept.

FIG. 2 is a graph showing the relationship between cost of oil produced through thermal stimulation for various fuels available in commercial quantities.

DETAILED DESCRIPTION OF THE INVENTION

Figure 3:
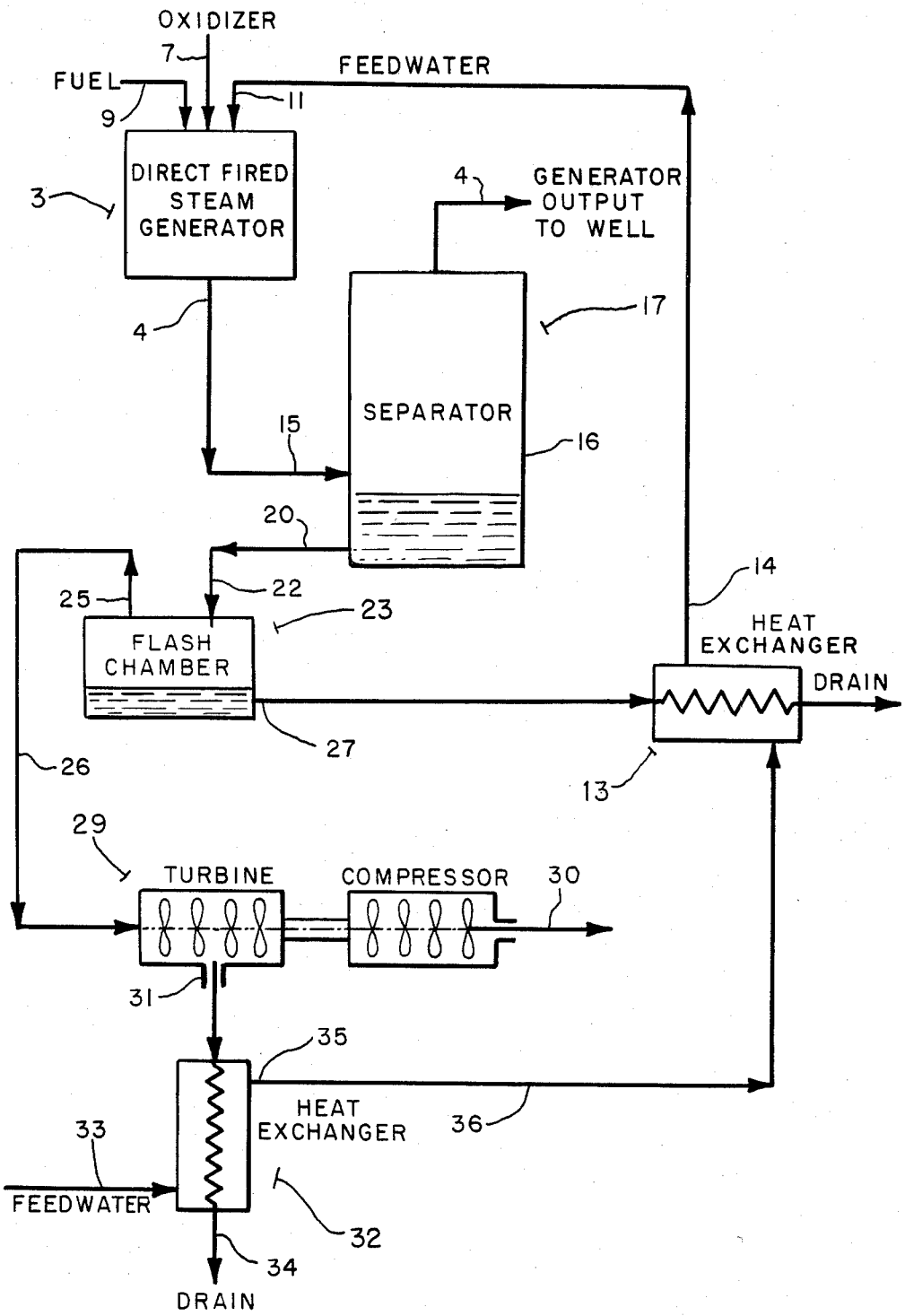
FIG. 3 is a semi-schematic drawing of the direct injection steam generating system of the invention, particularly incorporating thermal recovery from separated generator carryover water to drive the primary oxidant compressor.

Although disclosed in two embodiments and a "commercial" version, the concepts of applicant's invention are maintained, with each embodiment incorporating additional degrees of complexity. In order to best explain the applicant's invention, the following description utilizes primary, secondary, and "commercial" embodiments or versions.

A primary embodiment is shown in FIG. 1, wherein in a high pressure, direct-fired steam generator 3 is shown having a feedwater inlet 5, and oxidizer inlet 7, and a fuel inlet 9. The generator also has an outlet 4, communicating with a steam delivery/water separator assembly 17. The separator assembly 17 has a steam/-combustion gas outlet 19, a generator steam inlet 15, and a carryover water outlet 20. In fluid communication with the steam generator and water separator is a carryover water/generator heat recovery steam 13. The heat recovery system 13 has inlet 18, and outlet 14, and internal heat exchange means 19, for extracting heat or exchanging heat between high pressure feedwater source 21 and the burner 3 via conduit 11. Carryover water enters the heat exchange means 18 via conduit 20, exiting through outlet 14.

In operation in the direct-fired steam generator 3, a mixture of combustion gas and steam of predetermined quality, will enter the steam separator or the water carryover 17 via the conduit 15. Carryover water and certain products of combustion are retained in the separator tank 16, for transmittal to the heat recovery unit 13. High quality steam and combustion gases in a 50/50 (approximately) ratio by mass, exit the separator assembly 17 via the conduit 19. This combination of high quality, high temperature steam and high temperature combustion gases is then injected directly into the stimulated well. Since the injection is total, all steam and products of combustion are absorbed downhole.

Turning now to the secondary system embodiment disclosed in the representation of FIG. 3, the combination of a high pressure, direct-fired steam generator 3, and a carryover water/steam separator 17 are retained, as is the feedwater heat recovery system 13. However, additional carryover water flash chamber 23 communicates with the carryover water or steam evaporator tank 16 via conduit 20, and the flash chamber inlet 22. Flash chamber exit 25 communicates with a steam turbine or primary oxidant compressor assembly 29 via conduit 26.

The steam turbine or primary oxidant compressor shown as element 29 in the disclosed system may be one of several commercially available types. Thus, a typical system might include a pressure staged steam turbine driving, through appropriate gearing, a helical screw compressor. Alternately, an impulse turbine driving again through appropriate gearing a piston-type compressor could be used. Those skilled in the art will be aware of many other combinations which can, through the application of known principles, be utilized in the disclosed system.

The steam generator/oxidant compressor 29 has a steam condensate exit 31, and a high pressure oxidant outlet 30, communicating with the high pressure combustor inlet 7 via a suitable conduit (not shown), providing high pressure oxidant supply. It should be noted that although gaseous oxidants are disclosed in this application, those skilled in the art will readily see that liquid oxidants such as oxygen or others, could readily be handled by a suitably chosen compressor. A turbine condensate/feedwater heat recovery system 32 having a high pressure feedwater inlet 33 and an outlet 35, communicates with an additional exchange system 13 via conduit 27, providing feedwater heat extraction for residual carryover water contained in the flash unit 23. The additional feedwater heat recovery unit 13 communicates at its feedwater outlet 14 with the high pressure direct-fired steam generator at its feedwater inlet 11.

Figure 4:
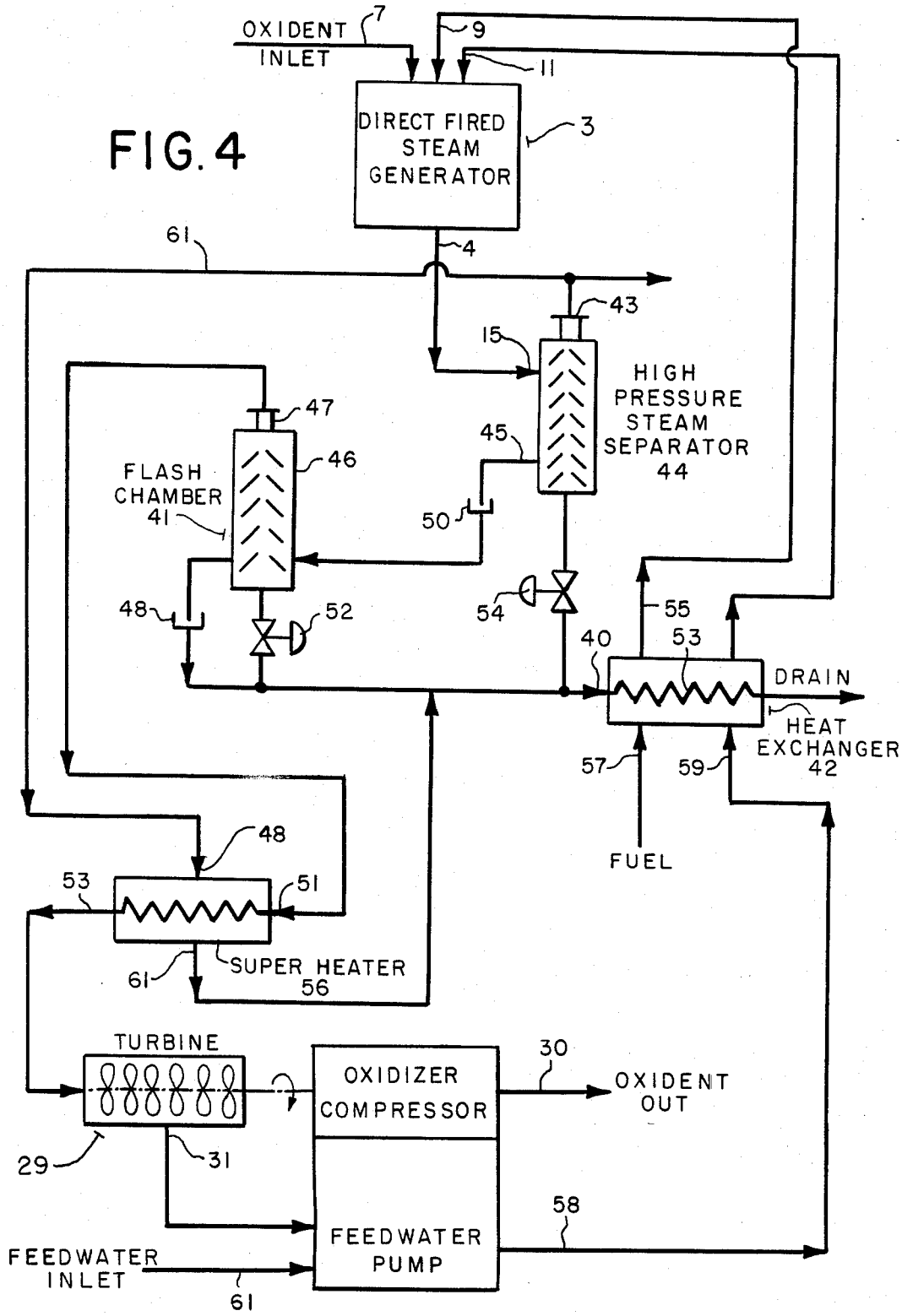
FIG. 4 is a partial schematic drawing showing the direct contact steam generating system of the invention in a "commercial" embodiment.

The "commercial" embodiment shown in FIG. 4 includes initial elements of the basic invention, i.e. a direct-fired steam generator 3, and a turbine/oxidant pump system 29. Additional components well known to those skilled in the art will be included in the following operational description.

The direct-fired steam generator 3, at its outlet 4, delivers steam to the inlet 15 of a high pressure steam separator 44 via its inlet 15. The steam separator 44 has an outlet 45 for communicating with the inlet of a carryover water flash chamber 46 at its inlet 41. A steam separator 50 is intermediate the outlet 45 and inlet 1. The generator steam separator 44 has an outlet 43 providing a mixture roughly 50/50 by weight of high quality, high pressure steam and high pressure combustion gases. Outlet 44 is fluidly communicated by appropriate means to a typical wellhead, providing thermal stimulation for tertiary oil recovery in the well. A conduit 61 in fluid communication with the steam generator separator 44 at its outlet 43, delivers a predetermined amount of steam to the inlet 48 of superheater 56. Carryover water flash chamber 46 at its outlet 47 delivers steam flashed from main generator carryover water to the steam inlet 51 of superheater 56. The function of the superheater 56 is to provide essentially high quality steam via outlet 53 to the steam drive turbine of the steam turbine/oxidant compressor assembly 29.

Both the high pressure generator steam separator 44 and flash chamber 46 incorporate adjustable condensate drain valves 54 and 52, respectively. This water is supplied to the flash chamber residual water, fuel, and feedwater heat recovery unit 42 via its inlet 40. As shown, the heat recovery unit 42 contains internal heat exchange means 53 providing fluid isolated means for preheating direct-fired steam generator fuel entering the heat recovery unit at its inlet 57 and delivering preheated fuel to the generator via its outlet 55 and generator inlet 9. Similarly, the heat recovery unit 42 is supplied feedwater via its inlet 59 and delivers preheated feedwater via its outlet 60 to the direct-fired steam generator feedwater inlet 11. As shown, any condensate from the oxidant drive turbine assembly 29 is recovered at its outlet 31 and delivered to the feedwater pump 58 along with additional treated feedwater supply 61, providing additional recovery of retained enthalpy available in the turbine condensate.

In operation, as in the above embodiments, the direct-fired steam generator delivers steam and combustion gases to the high pressure separator 44. High quality steam in predetermined quantities is supplied for both downhole recovery and/or superheating steam developed in the carryover water flash chamber 46. This predetermined amount of high quality, high pressure steam enters the superheater at 48 whereupon condensed steam is returned from the superheater condensate outlet 61 and returned to the feedwater/fuel heat recovery unit 42 via its inlet 40. It should be noted that any residual water remaining in either the separator 44 or flash chamber 46 is also returned to the heat recovery unit inlet 40 via calibrated valves 52 and 54. Steam traps 50 and 48 are also provided to maintain carryover water flow between the high pressure steam separator and flash chamber, and the flash chamber 46 and the feedwater/fuel heat recovery unit 42.

The systems disclosed above provide for utilization of the lowest cost available thermal energy source such as leased crude, heavy oil, or other combustible material. The combustor as disclosed in my co-pending application, through inventive and novel application of high pressure combustion, provides a means for utilizing heretofore undesirable fuels. When used in combination with the system disclosed, essentially all of the major energy requirements of steam drive tertiary oil recovery are wide via the combustion process. Further, no atmospheric pollution is present since all emissions are inductively injected downhole to aid in the recovery process.

It should be noted that use of applicant's discovery that a high pressure, direct-fired steam generator, properly designed and controlled can drastically reduce energy costs of thermal downhole stimulation, i.e. steam drive, while at the same time eliminating a major source of atmospheric pollution.

It is apparent that there has been provided in accordance with the invention disclosed, a direct-fired, high pressure steam generator and associated system utilizing novel thermal energy recovery means for operating from lowest cost available fuel, that fully satisfies the objects, aims and advantages set forth above. While the generator and systems disclosed have been described in terms of a primary, secondary and "commercial" embodiment, it will be evident to those skilled in the combustion and "steam drive" arts that many alternatives, variations, and substitutive modifications are apparent in the light of the descriptions as presented. Accordingly, applicant intends and contemplates all such alternatives, modifications and variations as fall within the scope of the appended claims.

Therefore, the following is claimed:

1. A method for thermal stimulation of existing petroleum wells comprising the steps of;

generating a first mixture of combustion products in a high pressure combustor having fuel and oxidizer inlets, and an outlet for delivery of said products;

generating a second mixture of steam and combustion products in a steam generator having a feedwater inlet, an inlet for receiving said combustor combustion products, adjacent said combustor outlet, and an outlet;

separating said water, and other combustion products from said second mixture, forming a third mixture of steam and combustion gases;

injecting said third mixture into said petroleum well in order to enhance crude oil output.

2. The method of claim 1 further comprising the steps of;

passing said separated water and other combustion products through the first side of a heat exchange system;

connecting said generator feedwater inlet and said heat exchanger second side to permit feedwater flow therethrough;

transferring heat from said separated water and combustion products to a second side of said heat exchanger thereby increasing generator efficiency.

3. The method of claim 1 further comprising the steps of;

flashing said separated water into secondary steam and a first residual water;

passing said secondary steam through a turbine thereby extracting residual energy;

operating a compressor with said turbine for supplying high pressure oxidizer to said generator.

4. The method of claim 3 further comprising the steps of;

passing said first residual water through a heat exchanger for transferring heat to said generator feedwater.

5. In equipment for thermal stimulation of petroleum wells through downhole injection of high temperature fluids of the type having a steam generator operating from a high pressure combustor, the improvement comprising;

a high temperature, high pressure combustor generating an output of gases and products of combustion;

a steam generator responsive to said combustor output delivering a first fluid mixture;

means separating said mixture for delivering primary steam and gases for injection and high temperature carryover water;

means flashing said carryover water, generating secondary steam and residual water;

means responsive to said secondary steam for compressing gaseous generator oxidizer;

means heating generator feedwater from said residual water;

means retaining said residual water.

6. The equipment of claim 5 wherein said combustor and generator comprise a high pressure direct fired steam generator.

7. The equipment of claim 5 wherein said secondary steam responsive means is a steam turbine.

* * * * *

UNITED STATES PATENT AND TRADEMARK OFFICE

CERTIFICATE OF CORRECTION

PATENT NO. : 4,498,542

DATED : February 12, 1985

INVENTOR(S) : Stephen Eisenhawer et al

It is certified that error appears in the above—identified patent and that said Letters Patent is hereby corrected as shown below:

Col. 3, line 62, change "steam" to --system--;
Col. 4, line 20, change "evaporator" to --separator--.

Signed and Sealed this

*Twelfth* Day of *November 1985*

[SEAL]

*Attest:*

DONALD J. QUIGG

*Attesting Officer*

*Commissioner of Patents and Trademarks*